US006006576A

United States Patent [19]

Genseberger et al.

[11] Patent Number: 6,006,576

[45] Date of Patent: Dec. 28, 1999

[54] SUPER STRETCH DRAW DIE AND METHOD

[75] Inventors: Erich Genseberger; Patrick Hickey; Tatsuo Umeda; Richard Tieu, all of Brampton, Canada

[73] Assignee: Cosma International Inc., Canada

[21] Appl. No.: 09/154,776

[22] Filed: Sep. 17, 1998

Related U.S. Application Data

[60] Provisional application No. 60/059,294, Sep. 18, 1997.

[51] Int. Cl.[6] ..... B21D 11/02

[52] U.S. Cl. ..... 72/315; 72/297

[58] Field of Search ..... 72/297, 298, 315, 72/300, 293

[56] References Cited

U.S. PATENT DOCUMENTS

| | | | |
|---|---|---|---|
| 2,961,028 | 11/1960 | Bath | 153/35 |
| 3,113,607 | 12/1963 | Maize | 153/35 |
| 3,133,607 | 5/1964 | Gardner et al. | 177/108 |
| 3,299,689 | 1/1967 | Dolney et al. | 72/297 |
| 3,452,573 | 7/1969 | Mackenzie | 72/297 |
| 3,597,955 | 8/1971 | Mackenzie | 72/297 |
| 3,948,071 | 4/1976 | Lieberman | 72/296 |
| 3,990,288 | 11/1976 | Mackenzie | 72/296 |
| 4,576,030 | 3/1986 | Roper | 72/296 |
| 4,698,995 | 10/1987 | Chorneau | 72/297 |
| 4,747,292 | 5/1988 | Chorneau | 72/297 |
| 5,600,991 | 2/1997 | Munzen | 72/348 |

OTHER PUBLICATIONS

International Search Report re: PCT/CA98/00860 dated Feb. 15, 1999.

*Primary Examiner*—Daniel C. Crane
*Attorney, Agent, or Firm*—Pillsbury Madison & Sutro LLP

[57] ABSTRACT

A die assembly for draw stamping sheet metal in a press. The die assembly has an upper die structure and a lower die structure, each constructed and arranged to me mounted on a press for reciprocal movement therebetween. The upper die structure and the lower die structure have complementary stamping surfaces for stamping sheet metal to a desired configuration. A clamping assembly and a stretching assembly grip the sheet metal along opposite sides of the complementary stamping surfaces and drivingly move apart in response to movement of the upper and lower die structures toward one another, thus pre-stretching the sheet metal as the upper and lower die structure are closed to stamp the sheet metal to a desired configuration.

41 Claims, 8 Drawing Sheets

SUPER STRETCH DRAW DIE AND METHOD

This application claims the benefit of U.S. Provisional Application No. 60/059,294, filed Sep. 18, 1997, which is hereby incorporated by reference.

FIELD OF INVENTION

The present invention relates to a stretch draw die assembly and method of stretch draw stamping sheet metal, and in particular body panels for motor vehicles.

The present invention pre-stretches sheet metal prior to a draw stamping operation in order to achieve a higher degree of stiffness and rigidity as a result of work-hardening the metal material. Preferably, the metal material is pre-stretched within the draw die assembly by 3%–6% prior to the sheet metal being deep drawn into its final configuration.

BACKGROUND OF THE INVENTION

In conventional draw stamping methods and draw stamping die assemblies, it has been known to effect a pre-stretching operation for pre-stretching the sheet metal to be stamped so as to work harden the sheet metal before it is drawn to the shape of the die cavity. A number of patents illustrate this principle, such as U.S. Pat. Nos. 3,113,607; 2,961,028; and 4,698,995. However, in prior art arrangements, the pre-stretching of material requires the use of separate hydraulic clamping and stretching assemblies which are moved to pre-stretch the sheet metal under the force of independently provided hydraulic power. The prior art arrangements are rather inefficient, cumbersome, and not very cost-effective. In addition, the prior art is lacking an arrangement wherein a pre-stretch operation can be accomplished efficiently in a conventional die press, and by utilizing the force or tonnage provided by the press.

SUMMARY OF INVENTION

The disadvantages of the prior art may be overcome by providing an efficient draw stamping die assembly which achieves a pre-stretching operation of sheet metal, and utilizes the tonnage of a conventional press in which the die assembly is mounted.

According to one aspect of the invention, there is provided a die assembly for draw stamping sheet metal in a press. The die assembly has an upper die structure and a lower die structure, each constructed and arranged to me mounted on a press for reciprocal movement therebetween. The upper die structure and the lower die structure have complementary stamping surfaces for stamping sheet metal to a desired configuration. A clamping assembly and a stretching assembly grip the sheet metal along opposite sides of the complementary stamping surfaces and drivingly move apart in response to movement of the upper and lower die structures toward one another, thus pre-stretching the sheet metal as the upper and lower die structure are closed to stamp the sheet metal to a desired configuration.

In accordance with another aspect of the invention, there is provided a die assembly for draw stamping sheet metal in a press comprising an upper die structure constructed and arranged to be mounted on a press ram for movement between raised and lowered positions. The upper die structure includes an upper stamping surface constructed and arranged to engage an upper surface of the sheet metal during a stamping operation. The upper die structure further includes an upper clamping surface and an upper stretching assembly on opposite sides of the upper stamping surface.

The upper stretching assembly includes an upper clamping structure, which is movable with respect to the upper clamping surface. The die assembly further includes a lower die structure having a lower stamping surface constructed and arranged to engage a lower surface of the sheet metal opposite the upper surface during the draw stamping operation. The lower die structure further includes a lower clamping surface and a lower stretching assembly on opposite sides of the lower stamping surface. The lower stretching assembly includes a lower clamp structure, which is movable with respect to the lower clamping surface. The upper die structure is movable by the press ram from the raised position towards the lowered position so that one end portion of the sheet metal is clamped between the upper and lower clamping surfaces, and so that an opposite end portion of the sheet metal opposite the one end portion is clamped between the upper clamp structure and the lower clamp structure. The upper clamp structure and the lower clamp structure are mounted for movement towards and away from said upper and lower clamping surfaces. Force imparting structure is mounted within the die assembly and constructed and arranged to impart force applied by the press ram to the upper and lower clamp structures so as to move the upper and lower clamp structures away from the upper and lower clamping surfaces after the one end portion of the sheet metal is clamped between the upper and lower clamping surfaces and the opposite end portion of the sheet metal is clamped between the upper clamp structure and the lower clamp structure, thus causing the sheet metal to be stretched by the force applied by the press ram. The upper stamping surface is movable towards the lower stamping surface by the press ram to engage the stretched sheet metal therebetween and thereby provide the sheet metal with a desired configuration.

It is also and object of the present invention to provide a method which addresses the concerns noted above. In accordance with this method, one end portion of sheet metal is clamped by a first clamping assembly of the die assembly and an opposite end portion of the sheet metal is clamped with a second clamping assembly of the die assembly. Force provided by the press is used to move the first clamping assembly away from the second clamping assembly to stretch sheet metal therebetween. The sheet metal is stamped between die surfaces of the die assembly after the sheet metal has been stretched as aforesaid.

Other objects and advantages of the present invention will become apparent from the following detailed description and appended drawings of a preferred embodiment.

DETAILED DESCRIPTION OF THE DRAWINGS

Figure 1:
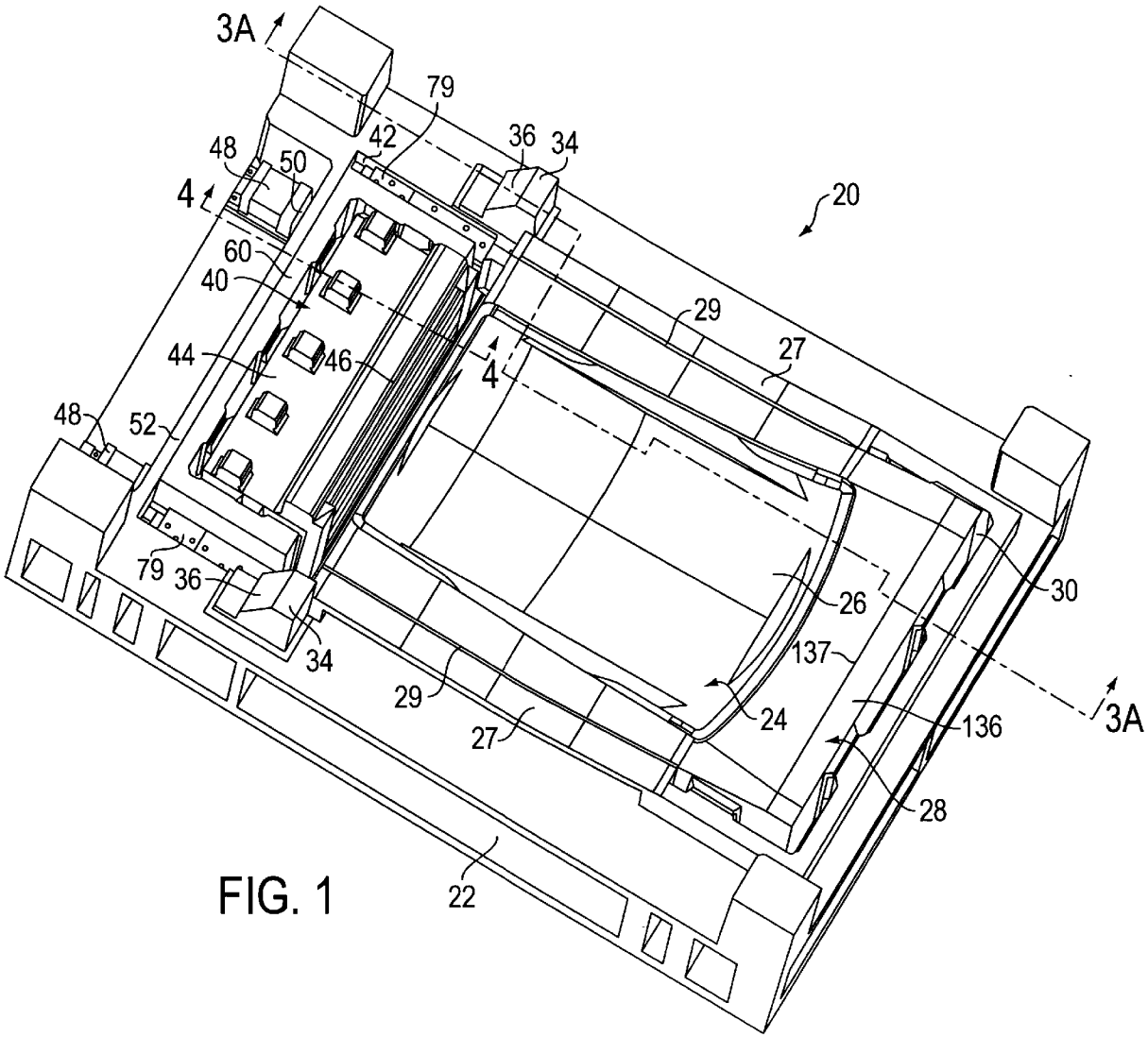
FIG. 1 is a perspective view showing the underside of an upper die structure of the die assembly in accordance with the present invention.

FIG. 1 is a perspective view showing the underside of an upper die structure, generally indicated at 20, in accordance with the present invention. The upper die structure 20 includes an upper die shoe 22 and a central upper die punch structure 24 rigidly fixed to the die shoe 22 and having a generally rectangular stamping surface 26 constructed and arranged to define the configuration of an upwardly facing surface of a rectangular sheet metal blank to be processed.

Disposed on two opposite sides of the upper die punch structure 24 are two side binder structures 27 which are rigidly fixed to the die shoe 22. The side binder structures are each provided with an elongated projecting bead 29, which is constructed and arranged to cooperate with a lower die (see FIG. 2) to grippingly engage the underside of the sheet metal to be processed generally along the opposite sides or end portions of the sheet metal underside. Disposed along a third side of the upper die punch structure 24 is a movable die pad structure 28 mounted in a recess 30 in the upper shoe 22. The die pad structure 28 is mounted for vertical movement relative to the upper shoe 22 as will be described.

Along the fourth side of the punch structure 24 opposite the aforementioned third side having die pad structure 28, is disposed an upper portion sheet metal stretching assembly, generally indicated at 40. The stretching assembly 40 is mounted generally within a recess 42 in the upper die shoe 22. The stretching assembly 40 includes an upper binder slide clamping structure 44 that defines an elongated projecting bead 46 used to cooperate with the lower die for clamping an adjacent portion of sheet metal to be stretched as will be described later in greater detail. The upper binder slide 44 is mounted on an upper cross slide structure 60, which is movable within the recess away from the punch structure 24 so that when the projecting bead 46 cooperates with the lower die structure the upward binder slide 44 can effectively stretch the sheet metal to be formed.

As also shown in FIG. 1, a pair of upper cam drivers 34 are force imparting structures for imparting the force of ram 23 as will be described later in greater detail. The cam drivers 34 are fixedly mounted on opposite sides of the shoe 22. The cam drivers 34 each have a downwardly facing slanted cam surface 36 which is constructed and arranged to cooperate with a cam surface provided on the lower die structure as will be described.

As also shown in FIG. 1, the stretching assembly 40 includes a pair of laterally spaced air cylinders 48 which have rod members 50 thereof projecting through a wall 52 of the upper die shoe 22. The rod 50 is connected with the upper cross slide structure 60 for returning the cross slide structure 60 to its original position, closer to the punch structure 24 after a stretching operation.

Figure 2:
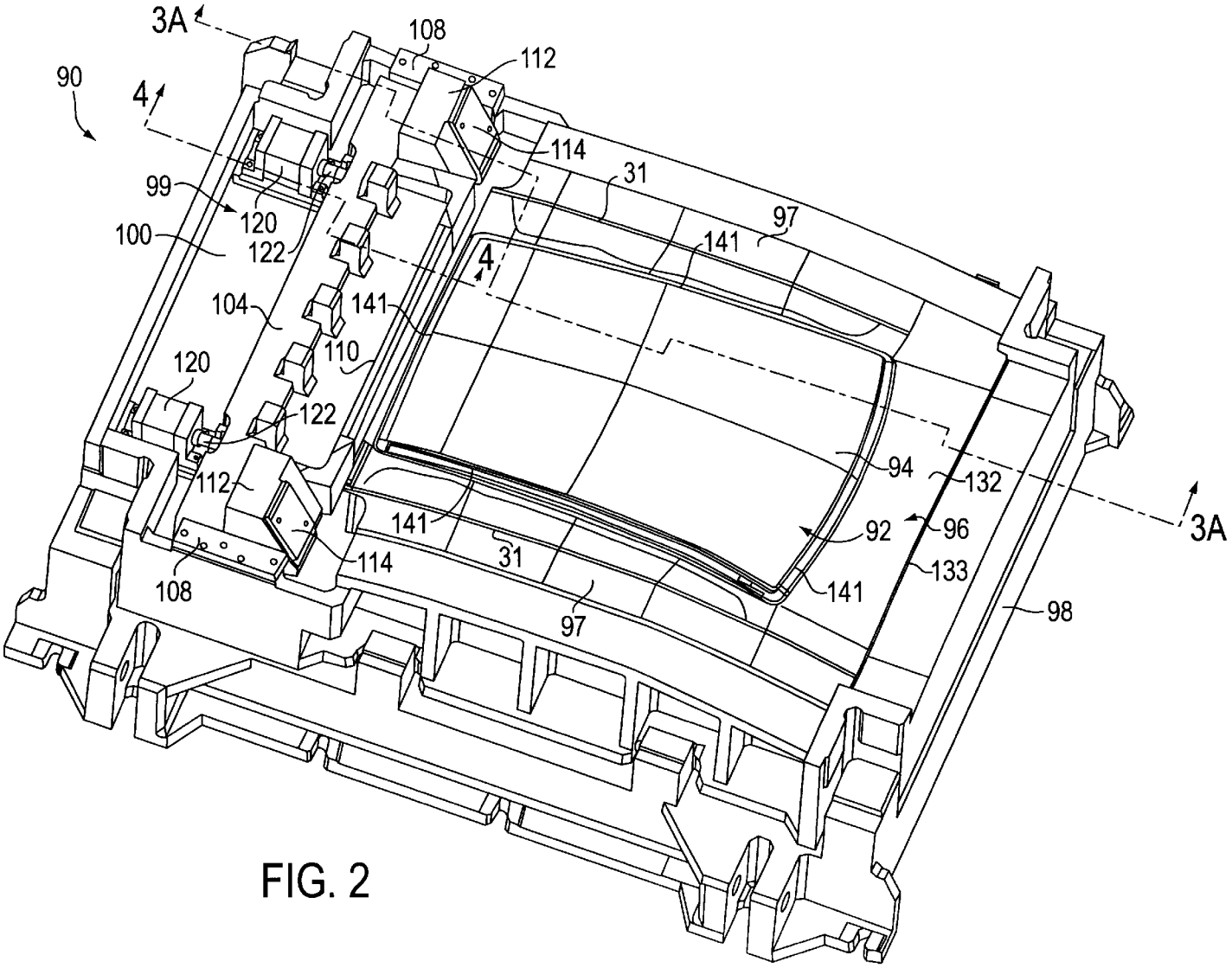
FIG. 2 is a perspective view showing the topside of a lower die structure of the die assembly in accordance with the present invention.
Figure 3A:
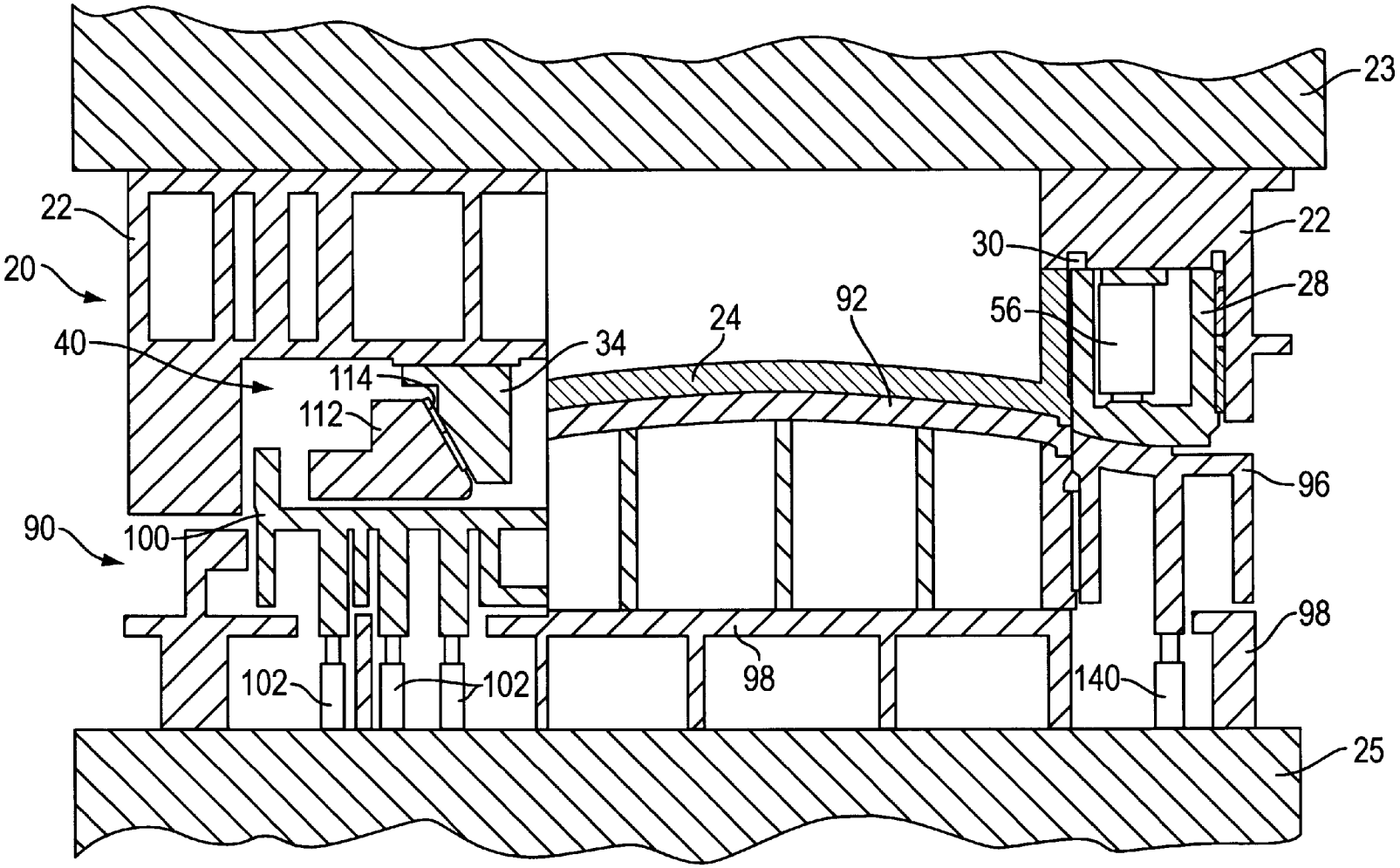
FIGS. 3A and 3B are sectional views taken through the line 3A—3A in FIG. 1 as they relate to the upper die structure, and through the line 3A—3A in FIG. 2 as they relate to the lower die structure.
Figure 3B:
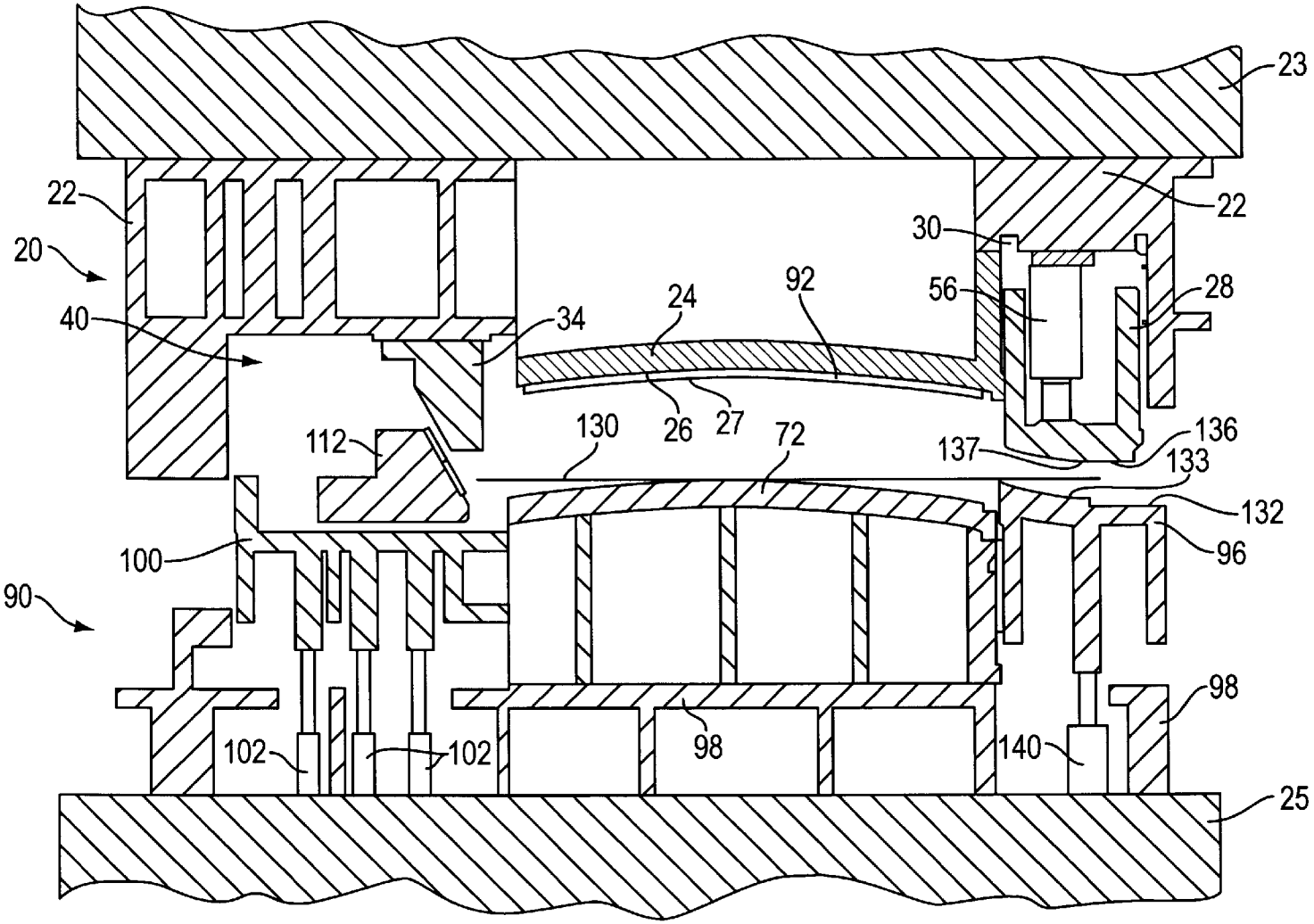

FIGS. 3A and 3B are sectional views taken through the line 3A—3A in FIG. 1 as they relate to upper die structure 20, and through the line 3A—3A in FIG. 2 as they relate to the lower die structure. FIG. 3A illustrates the upper die structure 20 in a lowered configuration and FIG. 3B shows the upper die structure 20 in a raised configuration. The upper and lower die structures are to be mounted in a conventional single action draw press. As shown in FIG. 3A, the upper die structure 20 is mounted on a press upper ram 23 of the conventional press. The press ram 23 is preferably driven hydraulically or mechanically (e.g., by an electric motor). The lower die structure 90 is shown mounted on a conventional press bed 25.

The upper die pad 28 disposed on the side of the punch structure 24 opposite upper stretching assembly 40 is mounted for vertical movement relative to the die shoe 22 and upper die punch structure 24. More particularly, the upper pad 28 has a generally U-shaped cross-sectional configuration which is received within the recess 30 of the upper die shoe 22. A plurality of nitrogen cylinders 56 are disposed within the recess 30, and more particularly within the interior of the U-shaped configuration of the upper die pad 28. The nitrogen cylinder 56 is expandable and retractable in conventional fashion to affect extension and retraction of the upper die pad 28 relative to the die shoe 22.

Figure 4:
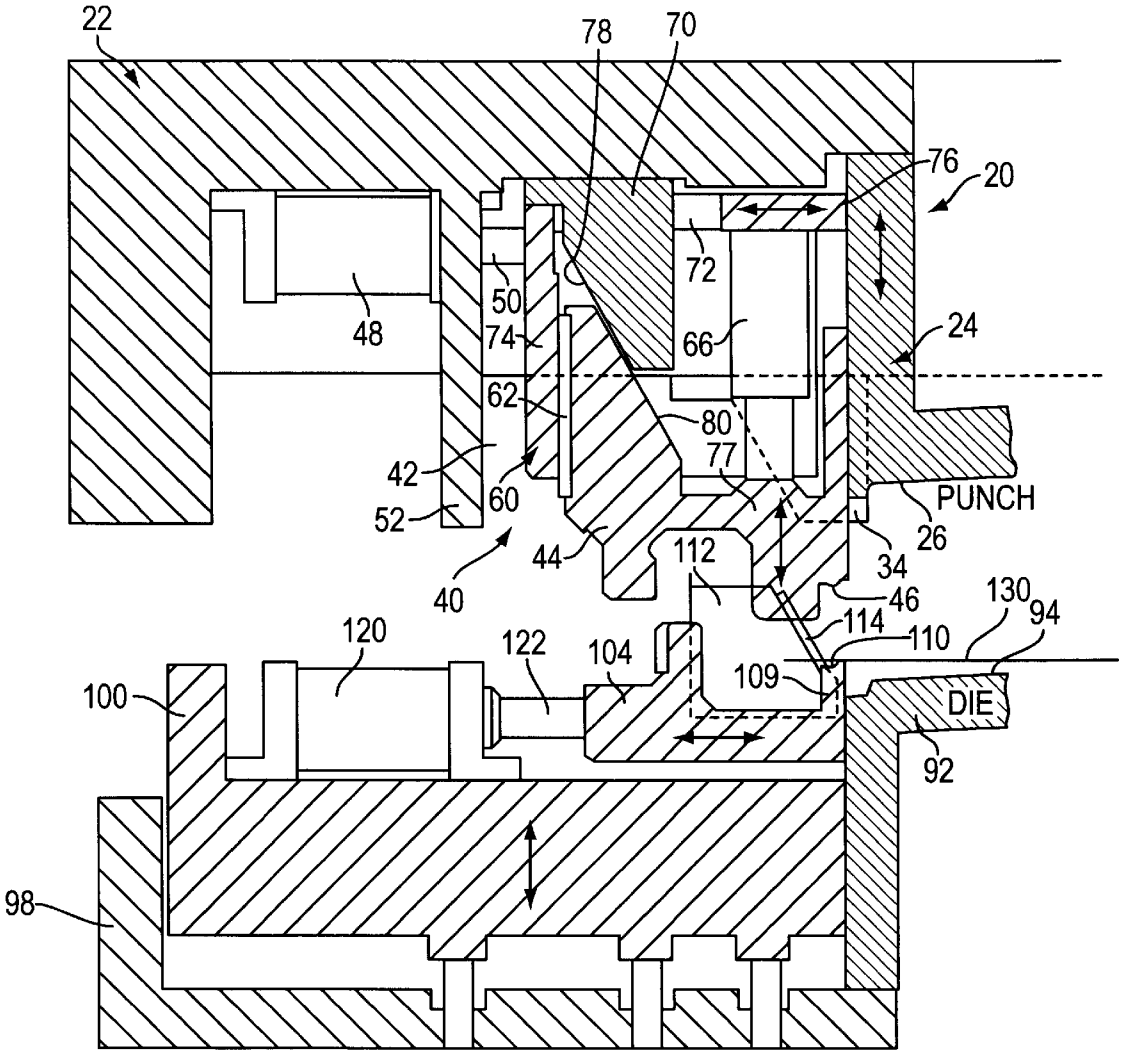
FIG. 4 is a sectional view taken through the line 4—4 in FIG. 1 as it relates to the upper die structure, through the line 4—4 in FIG. 2 as it relates to the lower die structure, and showing the die assembly in an opened or raised position.

FIG. 4 is a sectional view taken through the line 4—4 in FIG. 1 as it relates to the upper die structure 20, and through the line 4—4 in FIG. 2 as it relates to the lower die structure. FIG. 4 shows the full die assembly in an open position. As shown, the upper binder slide 44 is mounted for vertical movement on the upper cross slide structure 60. In particular, appropriate gib structures, such as that indicated at 62 are vertically disposed between a binder slide mounting portion 74 of the upper cross slide 60 and the upper binder slide 44 to permit relative vertical movement of the upper binder slide 44 with respect to the upper cross slide 60, the latter of which is tied for vertical movement with the upper die shoe 22. When the upper die structure 20 is in the open position, as illustrated in FIG. 4, the upper binder slide 44 is disposed in its lowermost position under the force of its own weight.

The upper die stretching assembly 40 further includes a vertically movable mounting device for mounting the binder slide clamp structure 44 for vertical movement. The vertically movable mounting device is preferably a biasing device, most preferably in the form of a nitrogen cylinder 66 which is connected between a cylinder mounting portion 76 of the upper cross slide 60 and mounting portion 77 of the upper binder slide 44 so as to restrict or control vertical movement of the upper binder slide 44 with respect to the upper cross slide 60.

The upper cross slide 60 is mounted to the upper die shoe 22 within the recess 42 for lateral or horizontal movement towards and away from the upper punch structure 24. In particular appropriate gib plate structures 79 (see FIG. 1) are disposed on opposite sides of the upper cross slide 60 to support the upper cross slide 60 relative to the die shoe 22 and to enable sliding movement of the upper cross slide 60 towards and away from the punch structure 24.

It should be appreciated that because the upper binder slide 44 is mounted on the upper cross slide 60, that lateral movement of the upper cross slide 60 towards or away from the punch structure 24 will move the upper binder slide 44 therewith.

As shown, the air cylinder 48 has the rod 50 thereof connected at its distal end thereof to the upper cross slide 60. As it will be discussed in greater detail later, the cylinder 48 and rod 50 thereof operate to move the upper cross slide 60 back towards the punch structure 24 into the position shown in FIG. 4 after the upper cross slide 60 has been moved away from the punch structure 24, such as can be appreciated from FIG. 5, which is a view similar to FIG. 4 but shows the full die assembly in a closed position.

Referring again to FIG. 4, the upper stretching assembly 40 further includes an upper drive cam structure 70, which is a force imparting structure in addition to force imparting structures 34, as will be described later in greater detail. The upper drive cam structure 70 is rigidly fixed to the upper die shoe 22 and extending downwardly into the recess 42. More particularly, the upper cross slide 60 has an opening 72 disposed between the vertically extending binder slide mounting portion 74 of the upper cross slide 60 and the horizontally disposed cylinder mounting portion 76 of the upper cross slide 60. The upper drive cam structure 70 extends downwardly through the aforedescribed opening 72. The upper drive cam structure 70 has a slanted cam surface 78 which is constructed and arranged to contact a cooperating cam surface 80 of the upper binder slide 44. As will be described in greater detail later, upward movement of the upper binder slide 44 relative to the upper drive cam structure 70 (or relative downward movement of the upper drive cam 70 relative to the upper binder slide 44) will cause lateral movement of the upper cross slide 60, and upper binder slide 44 connected for lateral movement therewith, in a direction away from the punch structure 24.

Turning now to FIG. 2, there is shown a perspective view of an upper side of a lower die structure, generally indicated at 90. The lower die structure 90 includes a lower draw die structure 92 having an upper die surface 94, preferably of a rectangular shape. The die surface 94 is constructed so as to define the desired stamped configuration of the sheet metal to be formed. The lower die structure 90 further includes a lower binder structure 96, which surrounds three sides of the lower draw die 92 in the present embodiment. The binder structure 96 is mounted for vertical movement with respect to a lower die shoe 98 by a plurality of nitrogen cylinders, and is adapted to cooperate with side binder structures 27 and die shoe structure 28 of the upper die structure 20, as will be described later.

Figure 5:
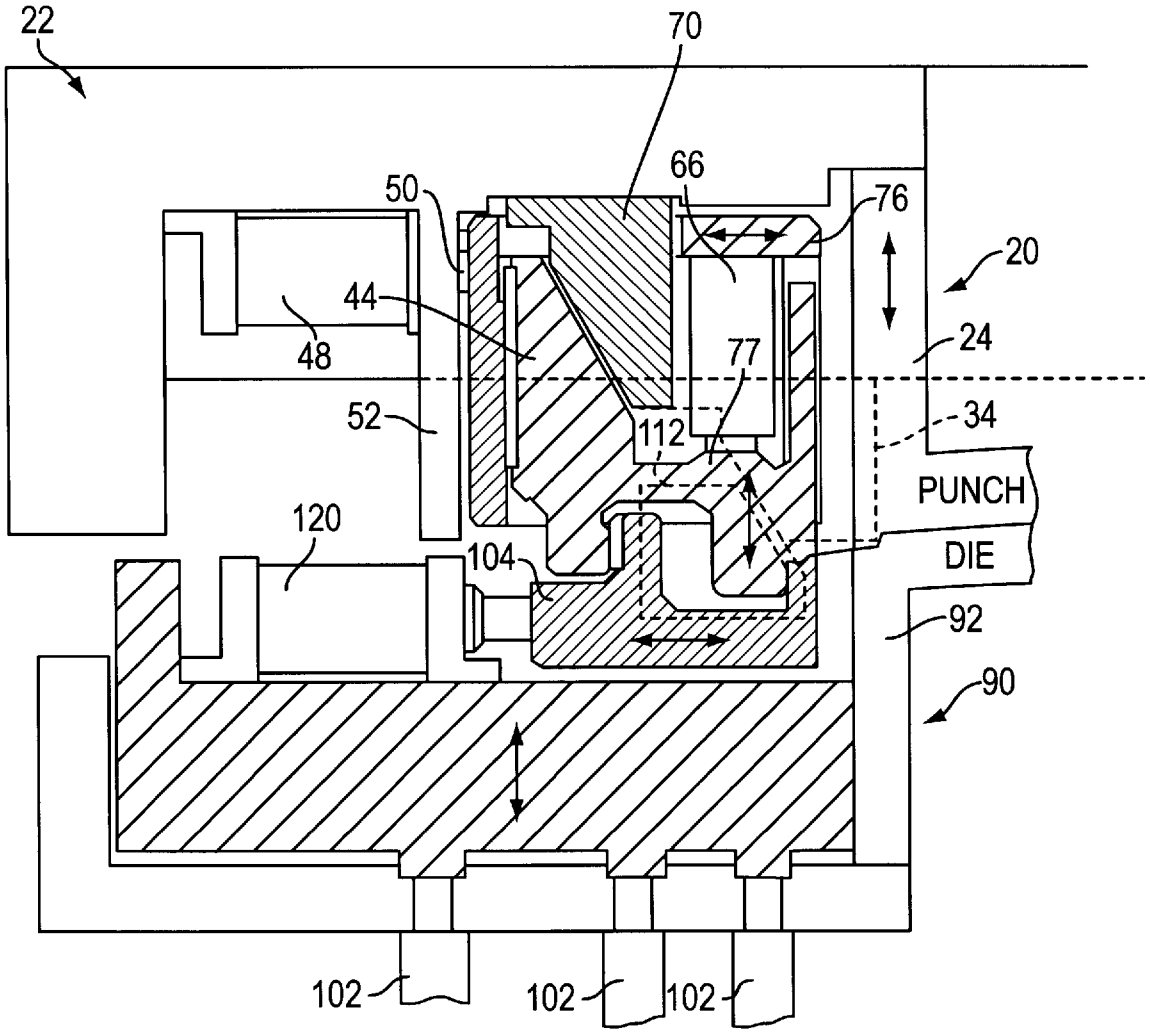
FIG. 5 is a view similar to FIG. 4, but showing the die assembly in a closed or lowered position.

The lower die structure 90 further includes lower portion stretching assembly 99 cooperable with the upper portion stretching assembly 40 to stretch the sheet metal to be formed. The lower portion stretching assembly includes a vertically movable structure, which includes a fourth side binder structure 100 mounted for vertical movement on the lower die shoe 98 by a plurality of nitrogen cylinders 102, as illustrated in FIGS. 4 and 5.

The present invention contemplates that the binder structure 100 may be integrally formed with or fixed to the three sided binder structure 96 to provide a complete ring structure which encircles the lower draw die structure 92. In the preferred embodiment described herein, however, the binder structure 100 is provided as an independently movable structure, which is movable independently of the three sided binder structure 96. Mounted on the vertically movable binder structure 100 is a lower binder slide structure clamp structure 104 which is mounted for movement relative to the lower binder slide structure 100 in a direction towards and away from the lower draw die structure 92. In particular, the opposite sides of the lower binder slide structure 104 are slidably carried by a pair of gib plate structures 108, which mount the lower binder slide 104 on the binder structure 100 for movement towards and away from the lower draw die 92. The lower binder slide 104 includes an upwardly projecting ledge portion 109 disposed at the portion of lower binder slide 104 immediately adjacent lower die structure 92. The upper surface of ledge portion 109 has an upwardly facing groove 10 constructed and arranged to cooperate with the projecting bead 46 of the upper binder slide 44 as will be described later in greater detail. In addition, the lower binder structure 104 includes a pair of lower cam slide members 112 fixed to opposite sides thereof. The cam slide members 112 are each provided with a wear plate 114. The lower cam slide members 112 cooperate with the upper cam driver structures 34 provided on the upper die structure 20 to enable movement of the lower binder structure 104 away from the lower draw die structure 92 as will be described. The wear plates 114 provide a wear surface between the upper cam driver structures 34 and the lower cam slide structures 112.

As seen in FIG. 4, the lower stretching assembly 99 further includes a pair of air cylinders 120 fixed to the lower binder structure 100. Each cylinder 120 has a piston rod extension 122, the distal end of which is connected to the lower binder slide structure 104. The air cylinders 120 operate to return the lower binder slide structure 104 to a position adjacent to the lower draw die structure 92 (i.e., the position shown in FIG. 4) after the lower binder slide structure 104 as been moved away from the lower draw die 92 in a stretching operation (as shown in FIG. 5).

Operation of the system will now be described.

The process begins with the configuration illustrated in FIG. 4. A pre-cut blank sheet of metal material 130 is placed upon the lower die structure 90. In particular, the underside of the blank 130 is laid to rest upon an upwardly facing, lower clamping surface 132 of the three-sided lower binder structure 96, so that the underside of the sheet blank 130 (preferably of a rectangular configuration) has its underside engaged along three peripheral edge portions thereof by surface 132. The surface 132 has a groove 133 which cooperates with a bead 137 provided on the lower clamping surface 136 of the upper die pad 28 of the upper die structure 20, to grip the material of the pre-cut metal blank 130. The pre-cut blank 130 may also have a central portion thereof resting upon the upper surface 94 of the lower die structure 92, although it is preferred for the central portion of the blank 130 to be slightly suspended above lower die structure surface 94 as shown in FIG. 4 to facilitate stretching of the material of blank 130. As also illustrated in FIG. 4, the fourth peripheral edge portion of the pre-cut blank 130 is mounted on the upper surface of ledge portion 109 of the lower binder slide 104. In the contemplated arrangement where the central portions of sheet metal 130 engage the lower die structure surface 94, the sheet metal may be slightly suspended above the upper surface of leg portion 109. Whether the edge of sheet metal 130 is suspended over the ledge portion 109 or not, it is contemplated that the sides of the sheet metal may be suspended over the side portions 97 of binder structure 96.

After the sheet metal 130 is mounted on lower die structure 90, the upper die shoe 22 is lowered by the press ram 23 until the lower surface 136 of the upper die pad 28 engages the upwardly facing surface of the sheet metal blank 130. The upper die shoe 22 continues to be lowered until the lower surface 136 of the upper die pad 28 sandwiches the blank 130 between the upwardly facing, lower clamping surface 132 of the lower binder structure 96 and the downwardly facing, upper clamping surface 136 of the upper die pad 28 along the side or end portion of the rectangular blank 130 opposite stretching assemblies 40 and 99. This end portion of the blank 130 is sandwiched between the upper die pad 28 and the lower binder structure 96 slightly prior to the stretching assembly 40 of the upper die structure and stretching assembly 99 of the lower die structure cooperate to stretch the fourth side of the blank. This is to prevent the blank 130 from being shifted when the stretching assemblies 40, 99 clamp the opposing end portion of blank 130.

It should be appreciated that after the blank 130 is initially clamped along one end portion between the upper die pad 28 and lower binder structure 96, continued downward movement of the upper die shoe 22 causes the cylinder 56 to become compressed between the upper die pad 28 and the upper die shoe 22, thereby increasing the gripping force applied by the upper die shoe 28 as the upper die shoe 22 is lowered. At the same time, the lower peripheral binder structure 96 is mounted on nitrogen cylinders 140, which permit the lower peripheral binder structure 96 to be lowered against the biasing force of the nitrogen cylinders 140 as the upper die structure 20 continues to be lowered in a draw stamping operation.

Figure 6:
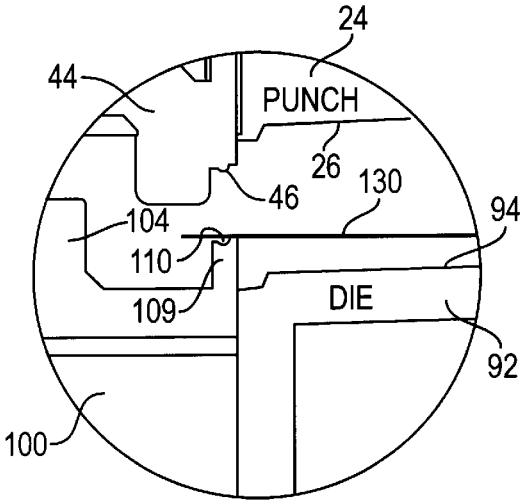
FIGS. 6–12 are enlarged views of relevant portions of FIG. 4 for the purpose of the following description of the operation of the pre-stretching method.
Figure 7:
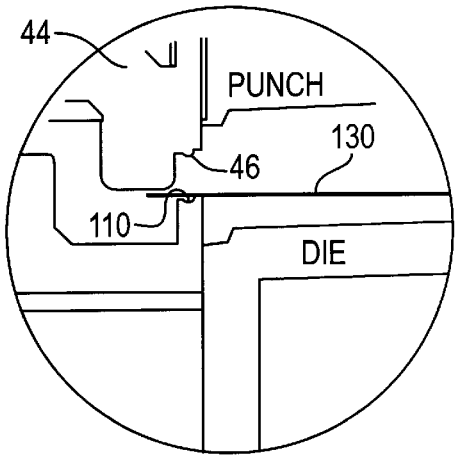

FIGS. 6–12 are enlarged views of relevant portions of FIG. 4 for the purpose of the following description of the operation of the pre-stretching method. As shown in FIGS. 6 and 7, continued lowering of the upper die structure 20 eventually causes the upper binder slide 44 to engage the upper surface of the blank 130. It should be appreciated that the engagement of the upper binder slide 44 with the end of blank 130 provides a resistance to further continued downward movement of the upper binder slide 44 so as to cause a slight compression of the cylinder 66 between the cylinder mounting structure 76 of the upper cross slide structure 60 and the mounting portion 77 of upper binder slide 44.

Figure 8:
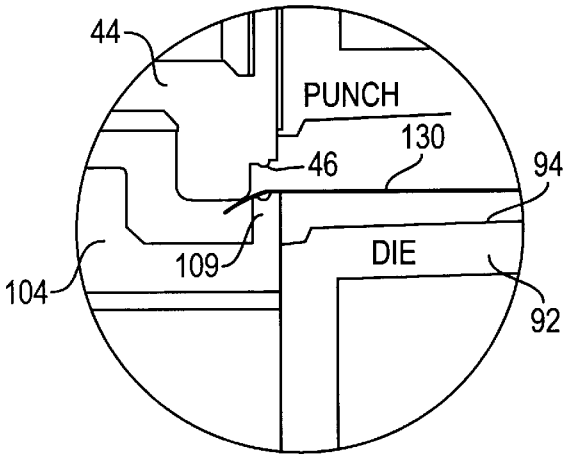
Figure 9:
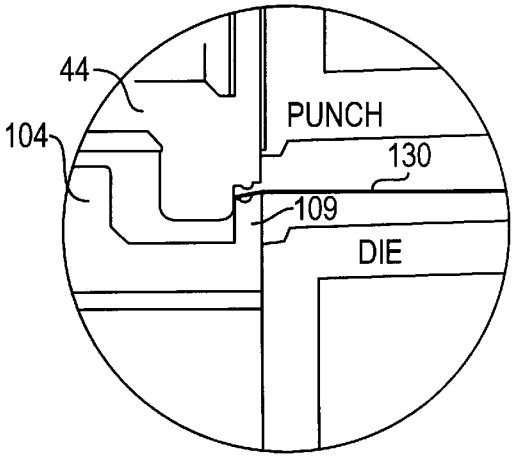

The press upper ram 23 continues its downward stroke, and as shown in FIG. 8, the upper binder slide 44 is deforming the blank material 130 down backside of the lower binder slide ledge portion 109. As shown in FIG. 9, the blank material 130 has now been formed at a 90° angle over the backside of the ledge portion 109 of lower binder slide 104.

It should be appreciated that in the described FIGS. 6–9, the opposite side or end portion of the blank material 130 continues to be gripped with increasing force by die pad 28 during lowering of the upper die structure 20, with a resultant increase in the pressure or force being applied by the opposing cylinders 56 and 140 (see FIG. 3A).

Figure 10:
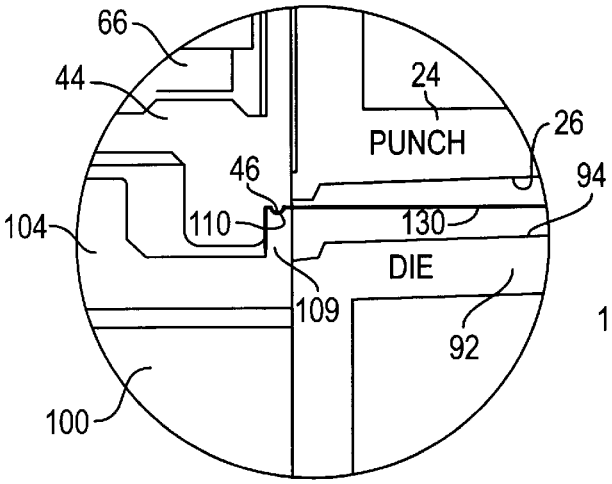

As shown in FIG. 10, continued downward movement of the upper die structure 20 eventually causes the upper binder slide 44 to bottom out against the lower binder slide 104. In particular, the end portion of the blank material 130 is now firmly grasped between the projecting bead 46 of the upper binder slide 44 and the extending groove 110 of the lower binder slide 104. At this stage of the operation, the blank material 130 is effectively locked at opposite sides or end portions thereof prior to pre-stretching of the blank material 130.

Further downward movement of the upper die structure 20 causes frictional sliding engagement between the cam surface 78 of the upper drive cam structure 70 and the cam surface 80 of the upper binder slide 44 (see FIGS. 4 and 5). As this camming action continues, the upper binder slide 44 becomes wedged between the relatively fixed upper drive cam structure 70 and the adjacent mounting wall portion 74 of the upper cross slide structure 60. This wedging action causes the upper cross slide structure 60 to move away from the upper die punch 24 so as to move the rods 50 back into their respective air cylinders 48. It should also be appreciated that further downward movement of the upper die structure 20 after the upper binder slide 44 has bottomed out as shown in FIG. 10 causes continued compression of nitrogen cylinder 66, thus causing an increase in the gripping force along projection 46 and groove 110.

When nitrogen cylinders 66 have been fully compressed, continued downward movement of the upper die structure causes downward movement of lower binder structure 100 against the biasing force of the lower die cylinders 102.

As can be appreciated from FIGS. 3*a* and 5, lowering of the upper die structure 20 effects lowering of the upper cam driver 34, until the cam driver 34 engages the wear plate 114 of the lower cam slide structure 112. Engagement of the upper cam driver 34, which is fixed relative to the die shoe 22, causes a camming effect on the lower cam slide structure 112, so as to drive the lower cam slide structure 112 and lower clamping structure 104 fixed thereto away from the lower draw die structure 92 in concert with the movement of the upper binder slide 44 and upper cross slide 60 away from the upper punch structure 24. Because the lower cam slide structure 112 is rigidly fixed to the lower binder slide 104, movement of the lower cam slide structure 112 away from the lower draw die structure 92 causes movement of the lower binder slide clamping structure 104 away from the lower die structure 92 at the same speed as, and while in engagement with, the upper binder slide 44. Movement of the lower binder slide 104 away from the lower die structure 92 in concert with the movement of the upper binder slide clamp structure 44 away from the upper punch structure 24 causes pre-stretching of the blank material, which is captured between the projection 46 of the upper binder slide 44 and the groove 110 of the lower binder slide 104. The pre-stretching of the metal blank 130 clearly illustrated in FIG. 11.

It should be appreciated that camming members 70 and 34 constitute force imparting structure mounted within the die assembly and which imparts force applied by the press ram 23 to the upper clamp structure 44 and the lower clamp structure 104, respectively. Thus, the force imparting structure translates the downward vertical force of the press ram 23 into horizontal force for stretching the sheet material 130. It should also be appreciated that after the upper clamp structure 44 cooperates with the lower clamp structure 104, the two clamping structures 44, 104 are effectively form-locked together. Thus, the present invention contemplates that only one of the camming members 70 or 34 may be used to accomplish the function of the force imparting structure. In addition, while the preferred construction is disclosed above, any other force imparting structure that can be used to translate the vertical force of the press ram 23 to horizontal stretching force can be used.

The upper portion stretching assembly 40 and the lower portion stretching assembly 99 together may be considered as a first clamping assembly, while the lower binder structure 96 and upper die pad 28 may be considered as a second clamping assembly. Movement of the first clamping assembly away from the second clamping assembly pre-stretches the sheet metal when clamped.

Figure 11:
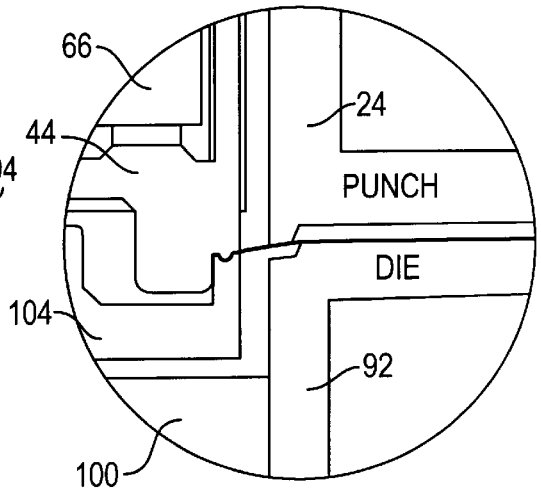

As mentioned previously, after the upper cylinder 66 is fully compressed, continued downward movement of the upper die structure 20 causes compression of the lower die cylinders 102, so as to effect downward movement of the lower binder slide 104, together with the air cylinders 120. As a result, as can be seen in FIG. 11, the pre-stretching action takes place not only in a direction away from the punch die structure 24 and lower draw die structure 92, but also in a downwards direction. While it is contemplated by the present invention that the downward movement of the lower binder slide 104, upper binder slide 44, and lower binder structure 100 can occur subsequent to the lateral or horizontal movement of the lower binder slide 104 and upper binder slide 44 stretching action, it is preferred for both the lateral and downward pre-stretching movement to occur at least partially simultaneously during the stretching operation. This is to say, that at least some of the downward movement occurs at the same time as at least some of the horizontal or lateral movement. Pre-stretching of the blank material 130 causes the lower surface thereof to be stretched across the upper surface 94 of the lower draw die structure 92.

Shortly after the relationship shown in FIG. 11 is reached, the upper side binder structures 27 begin to engage and clamp the sides of the sheet metal 130 against the cooperating side portions 97 of the lower binder structure 96. In particular, the projecting beads 29 of the side binder structures 27 formed on the upper die structure 20 cooperate with grooves 31 formed on the side structure 97 of the lower binder structure 96 to bind the two remaining sides of the sheet metal 130. As will be appreciated by those skilled in the art, the beads 29 and cooperating grooves 31, bead 46 and cooperating groove 110, and bead 137 and cooperating groove 133 define boundary lines beyond which substantially no stretching will occur. The binder wrap is then complete around the entire perimeter of the blank material 130. When pre-stretching is complete, the sheet material has been stretched between 3%–6%.

Figure 12:
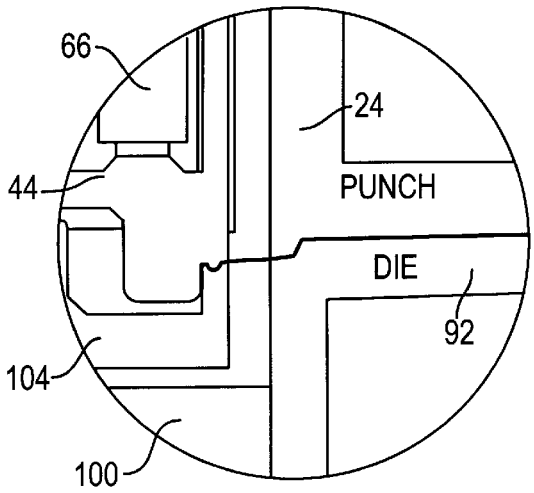

FIG. 12 illustrates arrangement in which the press upper ram completes its downward stroke to the predetermined draw-forming depth. The blank material 130 is drawn down over the shaped lower stamping surface 94 of the lower punch structure 24, and the material 130 is sandwiched between the mating upper stamping surface 26 of the upper punch structure 24 and the aforementioned lower stamping surface 94. This stretches the material 130 slightly more, after the pre-stretch operation, to achieve its final finished shape. In this post pre-stretch operation, the material is stretched generally in two directions, one which is parallel to the pre-stretch direction, and another which is perpendicular to the pre-stretch direction.

By pre-stretching the metal material, the material is work-hardened prior to the draw or stamping operation. This increases the rigidity of the material and reduced the amount of center point surface deflection. In addition, the occurrence of what is known in the art as "mouse-ear" deformation at the corners of the resultant part is minimized.

The press then passes through its bottom dead center and returns on its upward stroke. The material is then pushed upwards by the lower binder ring structure 96 under the force of nitrogen cylinders 140. The operator or a robot then removes the finished part from the die while it is in a relaxed state.

Prior to the beginning of the next cycle, the air cylinders 48 and 120 are energized to move the upper cross slide 60 and the lower binder slide 104 to their original positions. In addition, the sheer weight of the upper binder slide 44 permits it to return to its original position after it is lifted off the lower binder slide 104. The nitrogen cylinder 66 may exist in the controlled movement of the upper binder slide 44. In addition, the nitrogen cylinders 102 move the lower binder structure 100 and nitrogen cylinders 140 move the lower binder structure 96 upwardly into their original position as shown in FIGS. 3B and 4. Furthermore, the nitrogen cylinders 56 are permitted to expand to allow the die pad 28 to return to its extended position relative to die shoe 20.

While the above-described embodiment illustrates a system in which the upper and lower stretch assemblies 40 and 99 are disposed along only one side or end portion of the sheet metal blank, the present invention contemplates that such stretching assemblies may be provided on two, three, or even four sides. Where two sides are pre-stretched, they may be pre-stretched in opposite directions from opposite sides of the sheet metal, or alternatively, from adjacent sides to effect stretching in two separate directions. Where three sides or four sides are gripped by stretching assemblies similar to assemblies 40 and 99, the pre-stretching will necessarily occur in two separate directions.

In accordance with the present invention, it is preferred that the material be pre-stretched by between 3%–6% prior to the final drawing operation depicted in FIG. 12. Stretching the material prior to stamping in the manner described will improve the quality of the material by work-hardening it. It addition, cosmetics are improved, as this method will prevent what is known as "mouse-ear" deformation of the stamped product along the upper edges 141 of the lower die structure 92.

From the above, it can be appreciated that the die assembly of the present invention for draw stamping sheet metal in a press. The die assembly comprises the upper die structure 20 mounted on press ram 23 for movement between raised and lowered positions. The upper die structure 20 includes the upper stamping surface 26 constructed and arranged to engages an upper surface of the sheet metal 130 during a stamping operation. The upper die structure 20 further includes the upper clamping surface 136 and the upper stretching assembly 40 on opposite sides of the upper stamping surface 26. The upper stretching assembly 40 includes the upper clamping structure 44 which is movable with respect to the upper clamping surface 136. The die assembly further includes the lower die structure 90 having lower stamping surface 94 constructed and arranged to engage a lower surface of the sheet metal 130 opposite the upper surface of the sheet metal 130 during the draw stamping operation. The lower die structure 90 further includes the lower clamping surface 132 and lower stretching assembly 99 on opposite sides of the lower stamping surface 94. The lower stretching assembly 99 includes lower clamp structure 104 which is movable with respect to the lower clamping surface 132. The upper die structure 20 is movable by the press ram 23 from the raised position towards the lowered position so that one end portion of the sheet metal is clamped between the upper clamping surface 136 and lower clamping surface 132, and so that an opposite end portion of the sheet metal opposite the one end portion is clamped between the upper clamp structure 44 and the lower clamp structure 104. The upper clamp structure 44 and the lower clamp structure 104 are mounted for movement towards and away from said upper and lower clamping surfaces 136, 132. Force imparting structure 34,70 is mounted within the die assembly and constructed and arranged to impart force applied by the press ram 23 to the upper and lower clamp structures 44,104 so as to move the upper and lower clamp structures 44,104 away from the upper and lower clamping surfaces 136,132 after the one end portion of the sheet metal is clamped between the upper and lower clamping surfaces 136,132 and the opposite end portion of the sheet metal is clamped between the upper clamp structure 44 and the lower clamp structure 104, thus causing the sheet metal 130 to be stretched by the force applied by the press ram 23. The upper stamping surface 26 is movable towards the lower stamping surface 94 by the press ram 23 to engage the stretched sheet metal therebetween and thereby provide the sheet metal with a desired configuration.

The upper clamp structure 44 is mounted to said upper die structure 20 in a manner permitting relative vertical movement thereof with respect to the upper stamping surface 26. The upper stretching assembly 40 includes a biasing device 66 connected with the upper clamp structure 44 and constructed and arranged to yieldingly resist said relative vertical movement of said upper clamp structure 44 when the opposite end portion of the sheet metal 130 is engaged by the upper clamp structure 44 and the lower clamp structure 104 to facilitate clamping of the opposite end portion of the sheet metal 130 between the upper clamp structure 44 and the lower clamp structure 104.

It should also be appreciated that the lower stretching assembly 99 comprises vertically movable structure 100 mounted for vertical movement with respect to the lower stamping surface 94. The lower clamp structure 104 is mounted on the vertically movable structure 100 for vertical movement therewith. The upper stretching assembly 40 comprises vertically movable mounting structure 66 mounting the upper clamp structure 44 for vertical movement with respect to the upper stamping surface 26. The upper clamping surface 136 is mounted for vertical movement with respect to the upper stamping surface 26. The lower clamping surface 132 is mounted for vertical movement with respect to the lower stamping surface 94. The upper clamping surface 136 and lower clamping surface 132 are movable together in a vertical direction with the one end portion of sheet metal 130 clamped therebetween. The upper clamp structure 44 and lower clamp structure 104 are movable together in a vertical direction with the opposite end portion of sheet metal 130 clamped therebetween so as to stretch the sheet metal over the lower stamping surface 94 prior to the upper stamping surface 26 engaging the upper surface of the stretched sheet metal.

In accordance with the method of the present invention, one end portion of sheet metal 130 is clamped the first clamping assembly 40,99 of the die assembly 20,90. An opposite end portion of sheet metal 130 is clamped with a second clamping assembly 96,28 of the die assembly 20,90. Force provided by the press (e.g., see ram 23) is used to move the first clamping assembly 44,90 away from the second clamping assembly 96,28 to stretch sheet metal 130 therebetween. The sheet metal 130 is stamped between die surfaces 26 and 94 of the die assembly after the sheet metal has been stretched as aforesaid.

With respect to the method, it should also be noted that the first clamping assembly 40,99 and the second clamping assembly 96,28 are movable vertically with respect to the lower die surface 94. The first clamping assembly 40,99 and the second clamping assembly 96,28 are moved downwardly with respect to the lower die surface 94 so as to stretch the sheet metal 130 over the lower die surface 94 after the sheet metal 130 is stretched by the first clamping assembly 40,99 moving away from the second clamping assembly 96,28 and before stamping of sheet metal 130 between the die surfaces 26,94.

While the invention has been disclosed and described herein with reference to the preferred embodiment, it will be apparent that variations and modifications may be made therein without departure from the spirit and scope of the invention. Therefore, the following claims are intended to cover all such modifications, variations, and equivalents in accordance with the principles and advantages noted herein.

What is claimed:

1. A die assembly for draw stamping sheet metal in a press comprising:

an upper die structure and a lower die structure, each constructed and arranged to be mounted on a press for reciprocal movement therebetween, said upper die structure and said lower die structure having complementary stamping surfaces for stamping sheet metal to a desired configuration, a clamping assembly and a stretching assembly constructed and arranged to both a) grip said sheet metal along opposite sides of said complementary stamping surfaces and b) drivingly move apart in response to force generated by said upper die structure moving towards said lower die structure, pre-stretching said sheet metal as said upper die structure and said lower die structure are closed to stamp the sheet metal to said desired configuration.

2. A die assembly for draw stamping sheet metal in a press comprising:

an upper die structure and a lower die structure, each constructed and arranged to be mounted on a press for reciprocal movement therebetween, said upper die structure and said lower die structure having complementary stamping surfaces for stamping sheet metal to a desired configuration, a clamping assembly and a stretching assembly constructed and arranged to grip said sheet metal along opposite sides of said complementary stamping surfaces and to drivingly move apart in response to movement of said upper and lower die structures towards one another, pre-stretching said sheet metal as said upper die structure and said lower die structure are closed to stamp the sheet metal to said desired configuration, wherein said clamping assembly includes an upper clamping surface on said upper die structure and a lower clamping surface on said lower die structure and said stretching assembly includes an upper clamp structure on said upper die assembly and a lower clamp structure on said lower die structure, said upper clamp structure and said lower clamp structure being mounted for movement towards and away from said upper and lower clamping surfaces, and force imparting structure mounted within said die assembly and constructed and arranged to impart force to move said upper and lower clamp structures away from said upper and lower clamping surfaces after said one end portion of said sheet metal is clamped between said upper and lower clamping surfaces and said opposite end portion of said sheet metal is clamped between said upper clamp structure and said lower clamp structure, thus causing said sheet metal to be stretched as the upper and lower die structures move towards one another.

3. A die assembly according to claim 2, wherein said force imparting structure comprises a first camming structure comprising a camming surface which cams said upper clamp structure in a direction away from said upper and lower clamping surfaces.

4. A die assembly according to claim 3, wherein said force imparting structure comprises a second camming structure comprising a camming surface which cams said lower clamp structure in a direction away from said upper and lower clamping surfaces.

5. A die assembly according to claim 4, wherein said first camming structure is fixed to said upper die structure.

6. A die assembly according to claim 5, wherein said second camming structure is fixed to said lower die structure.

7. A die assembly according to claim 4, wherein said upper clamp structure comprises a camming surface constructed and arranged to engage the camming surface of said first camming structure, and wherein the force of said press ram causes said camming surface of said first camming structure to cam said camming surface of said upper clamp structure after said upper clamp structure and said lower clamp structure clamp said opposite end of said sheet metal therebetween, so as to move said upper and lower clamp structure in said direction away from said upper and lower clamping surfaces.

8. A die assembly according to claim 7, wherein said force imparting structure further comprises a second camming structure fixed to said upper die structure, said second camming structure fixed to said upper die structure being moved into forced engagement with a camming structure fixed to said lower clamp structure so as to drive said lower clamp structure in said direction away from said upper and lower clamping surfaces.

9. A die assembly according to claim 2, wherein said upper clamp structure is mounted to said upper die structure in a manner permitting relative vertical movement thereof with respect to said upper stamping surface, wherein said upper stretching assembly further comprises a biasing device connected with said upper clamp structure and constructed and arranged to yieldingly resist said relative vertical movement of said upper clamp structure when said opposite end portion of said sheet metal is engaged by said upper clamp structure and said lower clamp structure to facilitate clamping of said opposite end portion of said sheet metal between said upper clamp structure and said lower clamp structure.

10. A die assembly according to claim 2, wherein said lower stretching assembly comprises a vertically movable structure mounted for vertical movement with respect to said lower stamping surface, said lower clamp structure being mounted on said vertically movable structure for vertical movement therewith, said upper stretching assembly comprises a vertically movable mounting structure mounting said upper clamp structure for vertical movement with respect to said upper stamping surface, said upper clamping surface being mounted for vertical movement with respect to said upper stamping surface, said lower clamping surface being mounted for vertical movement with respect to said lower stamping surface, said upper clamping surface and said lower clamping surface being movable together in a vertical direction with said one end portion of said sheet metal clamped therebetween, and said upper clamp structure and lower clamp structure being movable together in a vertical direction with said opposite end portion of said sheet metal clamped therebetween so as to stretch said sheet metal over said lower stamping surface prior to said upper stamping surface engaging said upper surface of the stretched sheet metal.

11. A die assembly according to claim 10, wherein said upper and lower clamp structures move away from said upper and lower clamping surfaces simultaneously with said upper and lower clamp structures moving vertically with respect to said upper and lower clamping surfaces, respectively.

12. A die assembly according to claim 11, wherein portions of said sheet metal between said one end portion clamped between said upper and lower clamping surfaces and said opposite end portion clamped between said upper and lower clamp structures are suspended in spaced, overlying relation with respect to said lower stamping surface when said one end portion and said opposite end portion of said sheet metal are initially clamped, and wherein said upper clamp structure and said lower clamp structure are moved away from said upper and lower clamping surfaces by said force imparting structure to stretch said sheet metal prior to said sheet metal engaging said lower stamping surface.

13. A die assembly according to claim 10, wherein a length of said sheet metal between said one end and said opposite end is stretched at least 3% relative to its initial length by movement of said upper clamp structure and lower clamp structure away from said upper clamping surface and lower clamping surface.

14. A die assembly according to claim 13, wherein said stretching of at least 3% is accomplished prior to vertical movement of said upper and lower clamping surfaces and said upper and lower clamp structures, so that said stretching of at least 3% is accomplished prior to stretching said sheet metal over said lower stamping surface.

15. A die assembly according to claim 14, wherein said length of said sheet metal is stretched less than 6% prior to said stretching said sheet metal over said lower stamping surface.

16. A die assembly according to claim 10, wherein movement of said upper and lower clamp structures away from said upper and lower clamping surfaces stretches a length of said sheet metal between said one end and said opposite end thereof by at least 3% relative to its initial length.

17. A die assembly according to claim 10, wherein movement of said upper and lower clamp structures away from said upper and lower clamping surfaces stretches a length of said sheet metal between said one end and said opposite end thereof by at least 3% relative to its initial length, and wherein vertical movement of said upper and lower clamping structures and said upper and lower clamping structures and said upper and lower clamping surfaces for stretching said sheet metal over said lower stamping surface effects stretching of said sheet metal additional to said at least 3%.

18. A die assembly according to claim 10, wherein said vertically movable mounting structure comprises a binder structure mounted for vertical movement by a plurality of nitrogen cylinders.

19. A die assembly according to claim 10, wherein said upper and lower clamping surfaces are provided on binder structures mounted for vertical movement by nitrogen cylinders.

20. A method for draw stamping sheet metal in a draw stamping die assembly mounted in a press, said method comprising:

clamping one end portion of sheet metal with a first clamping assembly of said die assembly;

clamping an opposite end portion of said sheet metal with a second clamping assembly of said die assembly;

using force provided by said press to move said first clamping assembly away from said second clamping assembly to stretch said sheet metal therebetween; and stamping said sheet metal between die surfaces of said die assembly after said sheet metal has been stretched as aforesaid, wherein said clamping of the one end portion of said sheet metal and said clamping of the opposite end portion of said sheet metal are performed using said force provided by the press.

21. A method according to claim 20, wherein said first clamping assembly and said second clamping assembly are movable vertically with respect to a lower die surface of said die surfaces, said method further comprising:

moving said first clamping assembly and said second clamping assembly downwardly with respect to said lower die surface so as to stretch the sheet metal over said lower die surface after said sheet metal is stretched by said first clamping assembly moving away from said second clamping assembly and before said stamping of said sheet metal between the die surfaces.

22. A method for draw stamping sheet metal in a draw stamping die mounted in a press, said method comprising:

clamping one end portion of sheet metal with a first clamping assembly, said first clamping assembly having a cam surface;

clamping an opposite end portion of said sheet metal with a second clamping assembly;

using force provided by said press to move a camming structure of said stamping die into forcible engagement with said cam surface of said first clamping assembly so as to move said first clamping assembly away from said second clamping assembly so as to stretch said sheet metal therebetween in an initial stretching operation;

moving said first clamping assembly and said second clamping assembly together and relative to a first stamping die surface to stretch said sheet metal over said first stamping die surface to stretch said sheet metal in a further stretching operation subsequent to said initial stretching operation; and moving a second stamping die surface into engagement with said sheet metal to form said sheet metal between said first and second die surfaces after said sheet metal has been stretched in said initial stretching operation and said further stretching operation, wherein said clamping of the one end portion of said sheet metal and said clamping of the opposite end portion of said sheet metal are performed using said force provided by the press.

23. A die assembly for draw stamping sheet metal in a press comprising:

an upper die structure constructed and arranged to be mounted on a press ram for movement between raised and lowered positions, said upper die structure including an upper stamping surface constructed and arranged to engage an upper surface of said sheet metal during a stamping operation, said upper die structure further including an upper clamping surface and an upper stretching assembly on opposite sides of said upper stamping surface, said upper stretching assembly including an upper clamping structure which is movable with respect to said upper clamping surface;

a lower die structure including a lower stamping surface constructed and arranged to engage a lower surface of said sheet metal opposite said upper surface during said draw stamping operation, said lower die structure further including a lower clamping surface and a lower stretching assembly on opposite sides of said lower stamping surface, said lower stretching assembly including a lower clamp structure which is movable with respect to said lower clamping surface, said upper die structure being movable by said press ram from said raised position towards said lowered position so that one end portion of said sheet metal is clamped between said upper and lower clamping surfaces, and so that an opposite end portion of said sheet metal opposite said one end portion is clamped between said upper clamp structure and said lower clamp structure, said upper clamp structure and said lower clamp structure being mounted for movement towards and away from said upper and lower clamping surfaces, force imparting structure mounted within said die assembly and constructed and arranged to impart force applied by said press ram to said upper and lower clamp structures so as to move said upper and lower clamp structures away from said upper and lower clamping surfaces after said one end portion of said sheet metal is clamped between said upper and lower clamping surfaces and said opposite end portion of said sheet metal is clamped between said upper clamp structure and said lower clamp structure, thus causing said sheet metal to be stretched by the force applied by said press ram;

said upper stamping surface being movable towards said lower stamping surface by said press ram to engage said stretched sheet metal therebetween and thereby provide said sheet metal with a desired configuration.

24. A die assembly according to claim 23, wherein said force imparting structure comprises a first camming structure comprising a camming surface which cams said upper clamp structure in a direction away from said upper and lower clamping surfaces.

25. A die assembly according to claim 24, wherein said force imparting structure comprises a second camming structure comprising a camming surface which cams said lower clamp structure in a direction away from said upper and lower clamping surfaces.

26. A die assembly according to claim 24, wherein said first camming structure is fixed to said upper die structure.

27. A die assembly according to claim 25, wherein said second camming structure is fixed to said lower die structure.

28. A die assembly according to claim 26, wherein said upper clamp structure comprises a camming surface constructed and arranged to engage the camming surface of said first camming structure, and wherein the force of said press ram causes said camming surface of said first camming structure to cam said camming surface of said upper clamp structure after said upper clamp structure and said lower clamp structure clamp said opposite end of said sheet metal therebetween, so as to move said upper and lower clamp structure in said direction away from said upper and lower clamping surfaces.

29. A die assembly according to claim 23, wherein said upper clamp structure is mounted to said upper die structure in a manner permitting relative vertical movement thereof with respect to said upper stamping surface, wherein said upper stretching assembly further comprises a biasing device connected with said upper clamp structure and constructed and arranged to yieldingly resist said relative vertical movement of said upper clamp structure when said opposite end portion of said sheet metal is engaged by said upper clamp structure and said lower clamp structure to facilitate clamping of said opposite end portion of said sheet metal between said upper clamp structure and said lower clamp structure.

30. A die assembly according to claim 28, wherein said force imparting structure further comprises a second camming structure fixed to said upper die structure, said second camming structure fixed to said upper die structure being moved into forced engagement with a camming structure fixed to said lower clamp structure so as to drive said lower clamp structure in said direction away from said upper and lower clamping surfaces.

31. A die assembly according to claim 23, wherein said lower stretching assembly comprises a vertically movable structure mounted for vertical movement with respect to said lower stamping surface, said lower clamp structure being mounted on said vertically movable structure for vertical movement therewith, said upper stretching assembly comprises a vertically movable mounting structure mounting said upper clamp structure for vertical movement with respect to said upper stamping surface, said upper clamping surface being mounted for vertical movement with respect to said upper stamping surface, said lower clamping surface being mounted for vertical movement with respect to said lower stamping surface, said upper clamping surface and said lower clamping surface being movable together in a vertical direction with said one end portion of said sheet metal clamped therebetween, and said upper clamp structure and lower clamp structure being movable together in a vertical direction with said opposite end portion of said sheet metal clamped therebetween so as to stretch said sheet metal over said lower stamping surface prior to said upper stamping surface engaging said upper surface of the stretched sheet metal.

32. A die assembly according to claim 31, wherein said upper and lower clamp structures move away from said upper and lower clamping surfaces simultaneously with said upper and lower clamp structures moving vertically with respect to said upper and lower clamping surfaces, respectively.

33. A die assembly according to claim 23, wherein portions of said sheet metal between said one end portion clamped between said upper and lower clamping surfaces and said opposite end portion clamped between said upper and lower clamp structures are suspended in spaced, overlying relation with respect to said lower stamping surface when said one end portion and said opposite end portion of said sheet metal are initially clamped, and wherein said upper clamp structure and said lower clamp structure are moved away from said upper and lower clamping surfaces by said force imparting structure to stretch said sheet metal prior to said sheet metal engaging said lower stamping surface.

34. A die assembly according to claim 31, wherein a length of said sheet metal between said one end and said opposite end is stretched at least 3% relative to its initial length by movement of said upper clamp structure and lower clamp structure away from said upper clamping surface and lower clamping surface.

35. A die assembly according to claim 34, wherein said stretching of at least 3% is accomplished prior to vertical movement of said upper and lower clamping surfaces and said upper and lower clamp structures, so that said stretching of at least 3% is accomplished prior to stretching said sheet metal over said lower stamping surface.

36. A die assembly according to claim 35, wherein said length of said sheet metal is stretched less than 6% prior to said stretching said sheet metal over said lower stamping surface.

37. A die assembly according to claim 23, wherein movement of said upper and lower clamp structures away from said upper and lower clamping surfaces stretches a length of said sheet metal between said one end and said opposite end thereof by at least 3% relative to its initial length.

38. A die assembly according to claim 31, wherein movement of said upper and lower clamp structures away from said upper and lower clamping surfaces stretches a length of said sheet metal between said one end and said opposite end thereof by at least 3% relative to its initial length, and wherein vertical movement of said upper and lower clamping structures and said upper and lower clamping structures and said upper and lower clamping surfaces for stretching said sheet metal over said lower stamping surface effects stretching of said sheet metal additional to said at least 3%.

39. A die assembly according to claim 31, wherein said vertically movable mounting structure comprises a binder structure mounted for vertical movement by a plurality of nitrogen cylinders.

40. A die assembly according to claim 31, wherein said upper and lower clamping surfaces are provided on binder structures mounted for vertical movement by nitrogen cylinders.

41. A die assembly for draw stamping sheet metal in a press comprising:

an upper die structure constructed and arranged to be mounted on a press ram for movement between raised and lowered positions, said upper die structure including an upper stamping surface constructed and arranged to engage an upper surface of said sheet metal during a stamping operation, said upper die structure further including an upper clamping surface and an upper stretching assembly on opposite sides of said upper stamping surface, said upper stretching assembly including an upper clamping structure which is movable with respect to said upper clamping surface;

a lower die structure including a lower stamping surface constructed and arranged to engage a lower surface of said sheet metal opposite said upper surface during said draw stamping operation, said lower die structure further including a lower clamping surface and a lower stretching assembly on opposite sides of said lower stamping surface, said lower stretching assembly including a lower clamp structure which is movable with respect to said lower clamping surface, said upper die structure being movable by said press ram from said raised position towards said lowered position so that one end portion of said sheet metal is clamped between said upper and lower clamping surfaces, and so that an opposite end portion of said sheet metal opposite said one end portion is clamped between said upper clamp structure and said lower clamp structure, said upper clamp structure and said lower clamp structure being mounted for movement towards and away from said upper and lower clamping surfaces, force imparting structure mounted within said die assembly and constructed and arranged to impart force applied by said press ram to said upper and lower clamp structures so as to move said upper and lower clamp structures away from said upper and lower clamping surfaces after said one end portion of said sheet metal is clamped between said upper and lower clamping surfaces and said opposite end portion of said sheet metal is clamped between said upper clamp structure and said lower clamp structure, thus causing said sheet metal to be stretched by the force applied by said press ram;

said upper stamping surface being movable towards said lower stamping surface by said press ram to engage said stretched sheet metal therebetween and thereby provide said sheet metal with a desired configuration.

* * * * *